US006857908B2

(12) United States Patent
Burmeister

(10) Patent No.: US 6,857,908 B2
(45) Date of Patent: Feb. 22, 2005

(54) CONNECTOR WITH MOVABLE CONTACT ELEMENTS

(75) Inventor: Michael Burmeister, Minden (DE)

(73) Assignee: GmbH & Co. KG (DE)

( * ) Notice: Subject to any disclaimer, the term of this patent is extended or adjusted under 35 U.S.C. 154(b) by 0 days.

(21) Appl. No.: 10/348,462

(22) Filed: Jan. 21, 2003

(65) Prior Publication Data

US 2003/0143873 A1 Jul. 31, 2003

(30) Foreign Application Priority Data

Jan. 28, 2002 (DE) ..... 102 03 150

(51) Int. Cl.[7] ..... H01R 24/00
(52) U.S. Cl. ..... 439/632; 439/17; 439/637
(58) Field of Search ..... 439/632, 67, 637, 439/630, 493, 17, 700, 824, 439

(56) References Cited

U.S. PATENT DOCUMENTS

| | | | | | |
|---|---|---|---|---|---|
| 3,796,986 | A | * | 3/1974 | Tamburro | 439/329 |
| 3,941,448 | A | * | 3/1976 | Evans | 439/493 |
| 4,157,857 | A | * | 6/1979 | Sabo | 439/637 |
| 4,911,644 | A | * | 3/1990 | Bond et al. | 439/62 |
| 5,240,420 | A | * | 8/1993 | Roberts | 439/62 |
| 5,256,073 | A | | 10/1993 | Reymond et al. | 439/79 |
| 5,399,982 | A | * | 3/1995 | Driller et al. | 324/754 |
| 5,971,806 | A | * | 10/1999 | Evans et al. | 439/632 |
| 6,299,476 | B1 | | 10/2001 | Schramme et al. | 439/496 |
| 6,336,816 | B1 | * | 1/2002 | Yatskov et al. | 439/67 |
| 6,527,572 | B2 | * | 3/2003 | Jou | 439/248 |

FOREIGN PATENT DOCUMENTS

| | | | |
|---|---|---|---|
| DE | 441 022 A1 | 3/1995 | G06K/7/06 |
| EP | 1050842 A2 | 4/2000 | G06K/7/00 |
| FR | 1434935 | 4/1963 | |
| FR | 2775373 | 8/1999 | G06K/7/06 |

* cited by examiner

*Primary Examiner*—Tho D. Ta
*Assistant Examiner*—X. Chung-Trans
(74) *Attorney, Agent, or Firm*—Hayes Soloway P.C.

(57) ABSTRACT

A connector for receiving a plug-in card comprises a carrier which defines a receiving space for the plug-in card, at least one guide hole which is formed in the carrier and which opens in the receiving space, a contact element which is movably arranged in the guide hole, a spring which urges the contact element towards the receiving space, and a conductor path which is electrically connected with the contact element.

24 Claims, 6 Drawing Sheets

CONNECTOR WITH MOVABLE CONTACT ELEMENTS

This invention relates to a connector for receiving a plug-in card. The invention in particular relates to a connector for bonding an electrooptical transceiver, wherein signal transmission rates of about 10 Gbit per second are possible.

BACKGROUND OF THE INVENTION

Various connectors are known, which are used for signal transmission at high signal transmission rates, and which should ensure a particularly high signal transmission quality. Usually, first and second connector parts are used, one of which is mounted for instance on a carrier card and the other one is mounted on the component to be connected, for instance on the electrooptical transceiver. When inserting the plug-in card into its mount, the two connector parts are also inserted in each other.

The object of the invention consists in creating a connector which provides for a high signal transmission quality with a high signal transmission rate and little effort. The object of the invention in particular consists in creating a connector in which a plug-in card to be connected can directly be inserted in the connector without a connector part having to be mounted at the plug-in card.

BRIEF DESCRIPTION OF THE INVENTION

The invention provides a connector for receiving a plug-in card, comprising a carrier which defines a receiving space for the plug-in card, at least one guide hole which is formed in the carrier and opens in the receiving space, a contact element which is movably arranged in the guide hole, a spring which urges the contact element towards the receiving space, and a conductor path which is electrically connected with the contact element. The invention is based on the fundamental idea to use small contact elements between the conductor paths of the plug-in card and the conductor paths of the connector, which contact elements are movable transverse to the direction of insertion of the plug-in card. The contact elements must be movable, as otherwise the plug-in card cannot be bonded with a precisely adjusted contact force; only by using a spring is it possible to always ensure a reliable bonding with a constant contact force even in the case of possibly existing manufacturing tolerances. The spring itself, however, is hardly suited for bonding when RF signals are to be transmitted; with regard to the required spring characteristics, the spring must be very much larger than is expedient for the transmission of RF signals. Therefore, the contact elements are used between the conductor paths and the plug-in card.

In accordance with a first embodiment of the invention, the contact elements are contact balls which are movably arranged in the guide hole. Contact balls are easy to produce. In addition, during insertion of the plug-in card the contact balls partly roll on the surface thereof, whereby a very good self-cleaning is obtained, not only between the plug-in card and the contact ball, but also between the contact ball and the conductor path of the connector.

With regard to compact dimensions, the contact balls are designed with as small a diameter as possible, for instance in the order of 0.5 mm.

In accordance with a preferred embodiment of the invention it is provided that on its side facing the receiving space the guide hole is provided with a collar whose diameter is smaller than the diameter of the contact ball. This prevents the contact ball from falling from the guide hole into the receiving space, when no plug-in card is disposed in the receiving space in the carrier.

In accordance with a second embodiment of the invention, the contact element is a contact pin which is movably arranged in the guide hole. A pin is somewhat more expensive to produce, but promises to have advantages in terms of RF signal transmission.

The contact pin preferably has a rounded tip, a cylindrical guide portion and adjacent thereto an expanded holding portion, the diameter of the guide portion approximately corresponding to the diameter of the guide hole. in this way, a shoulder is formed, which serves as a stop for the contact pin, so that the guide hole can be designed to continuously have the same diameter. This reduces the manufacturing effort for the carrier body.

The contact pin has a diameter in the order of maximally 0.5 mm, preferably a diameter of about 0.1 mm. In this way, a compact structure can be achieved. In the same way as the contact ball, the contact pin preferably is gold-plated.

Preferably, it is provided that the spring is a bow-type spring with an anchoring portion, a bending portion, and a spring portion which acts on the contact element. In this way, a long spring travel is obtained, which in turn leads to a small change in the spring force upon deflection of the contact element. The spring preferably is mounted on a housing to which the carrier is attached. For fastening the spring, fastening pins may be provided at the housing, which engage in mounting holes in the anchoring portion of the spring.

Preferably, it is provided that the conductor path is formed on a flexible conductor foil and ends in a contact field against which the contact element rests. Due to its flexibility, the conductor foil is particularly suited to achieve a reliable bonding with the movably arranged contact element with little effort and little building space.

In accordance with a preferred embodiment of the invention it is provided that the contact field is drop-shaped, the width of the contact field approximately corresponding to the diameter of the contact element. The tip of the contact field serves for connection to the associated conductor path, whereas the belly of the contact field is large enough to provide for a reliable bonding of the contact element even in the case of possibly existing manufacturing tolerances. Since the width of the contact field is approximately equal to the diameter of the contact element, good radiofrequency properties are obtained.

To achieve a compact structure, the conductor foil preferably is arranged between the spring and the carrier, the spring pressing on the side of the conductor foil facing away from the contact field. For precisely positioning the conductor foil in this region, fixing pins may be provided, which are formed at the carrier and extend through fixing holes in the conductor foil.

The connector can for instance be mounted on a printed circuit board. For connecting the conductor foil it is provided that the same extends to outside the housing and the conductor path ends there with a soldering surface. In this way, known surface mounting methods can be used, in order to electrically connect the connector with the printed circuit board.

In accordance with the preferred embodiment of the invention, first and second rows of contact elements are provided, which are arranged on opposed sides of the carrier. With this arrangement of the contact element a particularly small force is required to insert the plug-in card into the carrier, as during insertion the plug-in card is floatingly guided between the opposed rows of contact elements.

Preferably, it is provided that the contact elements of the first row are electrically connected with conductor paths extending inside a shielded conductor foil, and that the contact elements of the second row are electrically connected with conductor paths extending on the surface of a conductor foil. This embodiment thus uses signal routes of different qualities, namely in the case of the contacts of the first row particularly well shielded contacts, which are especially suited for a high-frequency signal transmission, and in the case of the contacts of the second row a lower quality, as is sufficient for instance for power transmission.

In the case of the shielded conductor foil it is preferably provided that two conductor paths each are designed as symmetrical conductor pairs, in order to achieve a high signal transmission quality.

When a plug-in card provided with contact surfaces is inserted in the receiving space of the connector, the contact elements rest on the contact surfaces with a defined contact force which is determined by the spring. This contact force is hardly influenced by possibly existing manufacturing tolerances, as the contact elements are acted upon by the spring individually, i.e. independent of the adjacent contact element.

Advantageous aspects of the invention can be taken from the sub-claims.

BRIEF DESCRIPTION OF THE DRAWINGS

The invention will subsequently be described with reference to a preferred embodiment which is represented in the attached drawings, in which.

DETAILED DESCRIPTION OF THE INVENTION

Figure 1:
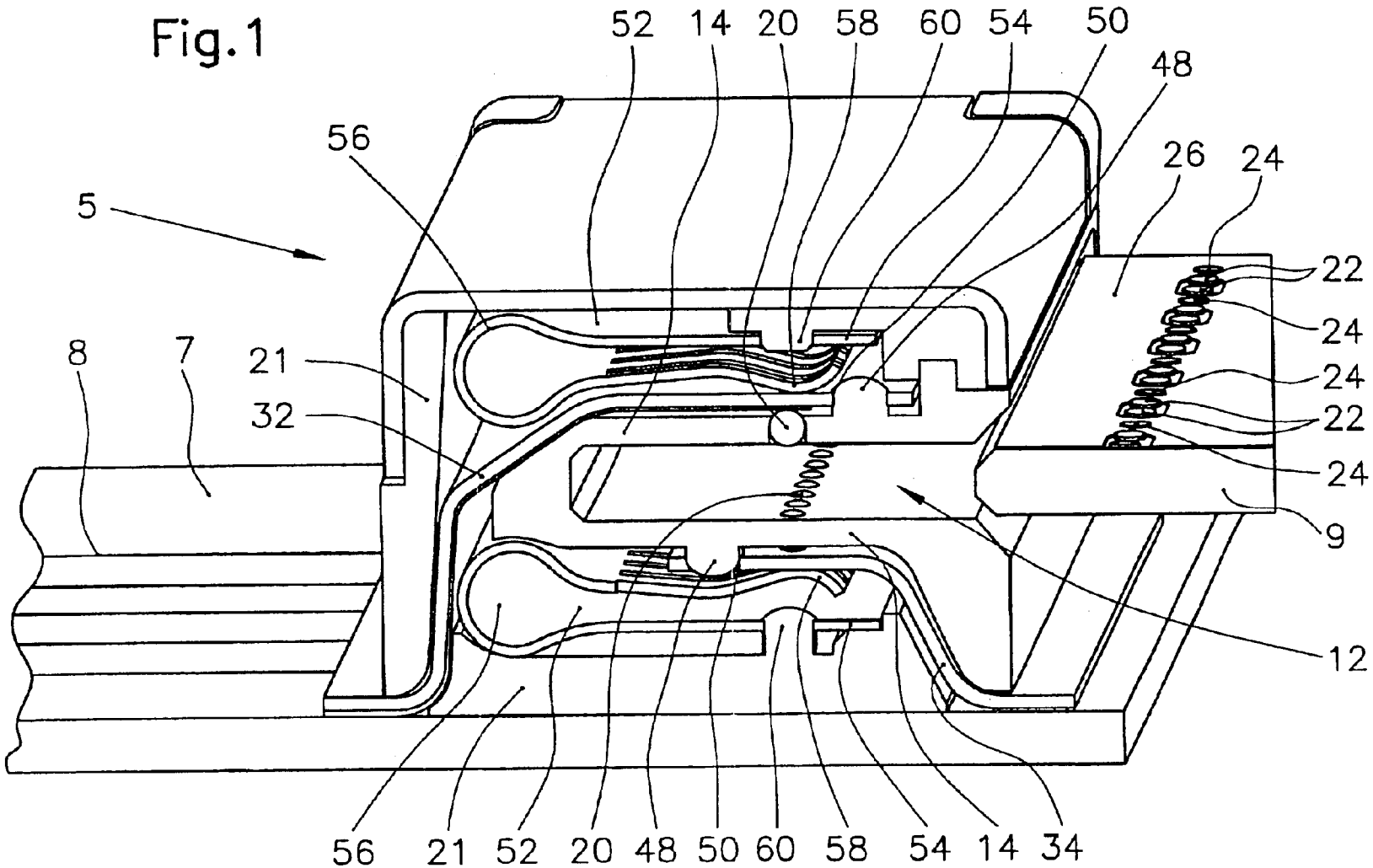
FIG. 1 shows a connector in accordance with a first embodiment of the invention with an associated plug-in card in a perspective sectional view.
Figure 2:
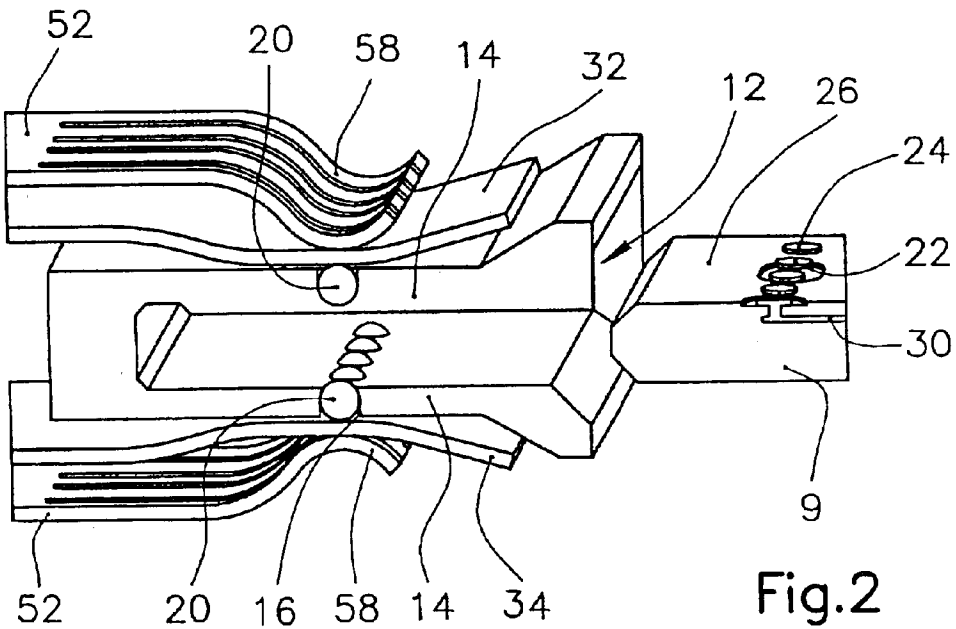
FIG. 2 shows various components of the connector of FIG. 1 in a view corresponding to that of FIG. 1.
Figure 3:
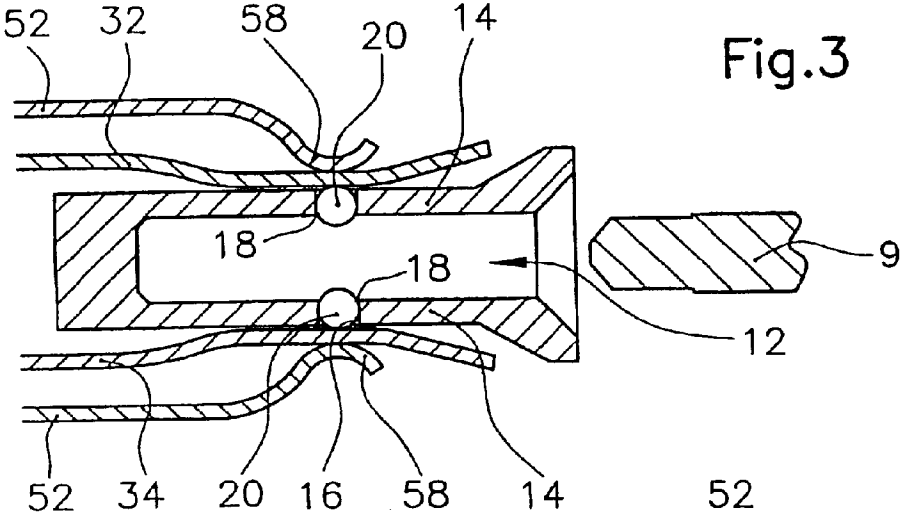
FIG. 3 shows the components of FIG. 2 in a sectional view.

FIG. 1 shows a connector 5 in accordance with a first embodiment. This connector is arranged on a printed circuit board 7, which is provided with schematically indicated conductor paths 8. Into the connector 5, a plug-in card 9 can be inserted such that conductor paths of the plug-in card 9 are bonded electrically.

As central component, the connector 5 has a carrier 10 in which a receiving space 12 of rectangular cross-section is formed for the plug-in card 9. The carrier 10 is made of an electrically insulating material, in particular plastics. In the two larger side walls 14 of the carrier 10, there is formed a plurality of guide holes 16 disposed one beside the other in a row, which extend as through hole from the receiving space 12 through the side wall 14 towards the outside. Each guide hole 16 constitutes a bore of circular cross-section, and on its side facing the receiving space 12 a collar 18 is provided, whose inside diameter is smaller than the diameter of the remaining portion of the guide hole 16. The longitudinal axis of each guide hole extends approximately perpendicularly to the direction of insertion of the plug-in card into the carrier body.

In each guide hole 16 a contact element is disposed, which here is designed as contact ball 20. The diameter of the contact ball is slightly smaller than the diameter of the guide hole, but larger than the inside diameter of the collar 18. In this way, each contact ball 20 is movable in its guide hole 16, but it is prevented from entering completely into the receiving space 12. The dimensions of each contact ball 20 as well as of the associated guide hole 16 with collar 18 are adjusted to each other such that the contact ball 20 can protrude beyond the inner surface of the corresponding side wall 14 and into the receiving space 12.

Alternatively, the guide holes 16 can also be designed conical, so that the collar 18 can be omitted. The diameter of the guide hole then has such a profile that at the end of the guide hole 16 opening in the receiving space 12 the contact ball 20 cannot escape from the same.

At least on its surface, each contact ball 20 is electrically conductive. For this purpose, each contact ball 20 is coated with gold. The diameter of each contact ball 20 lies in the order of about 0.5 mm.

Figure 4:
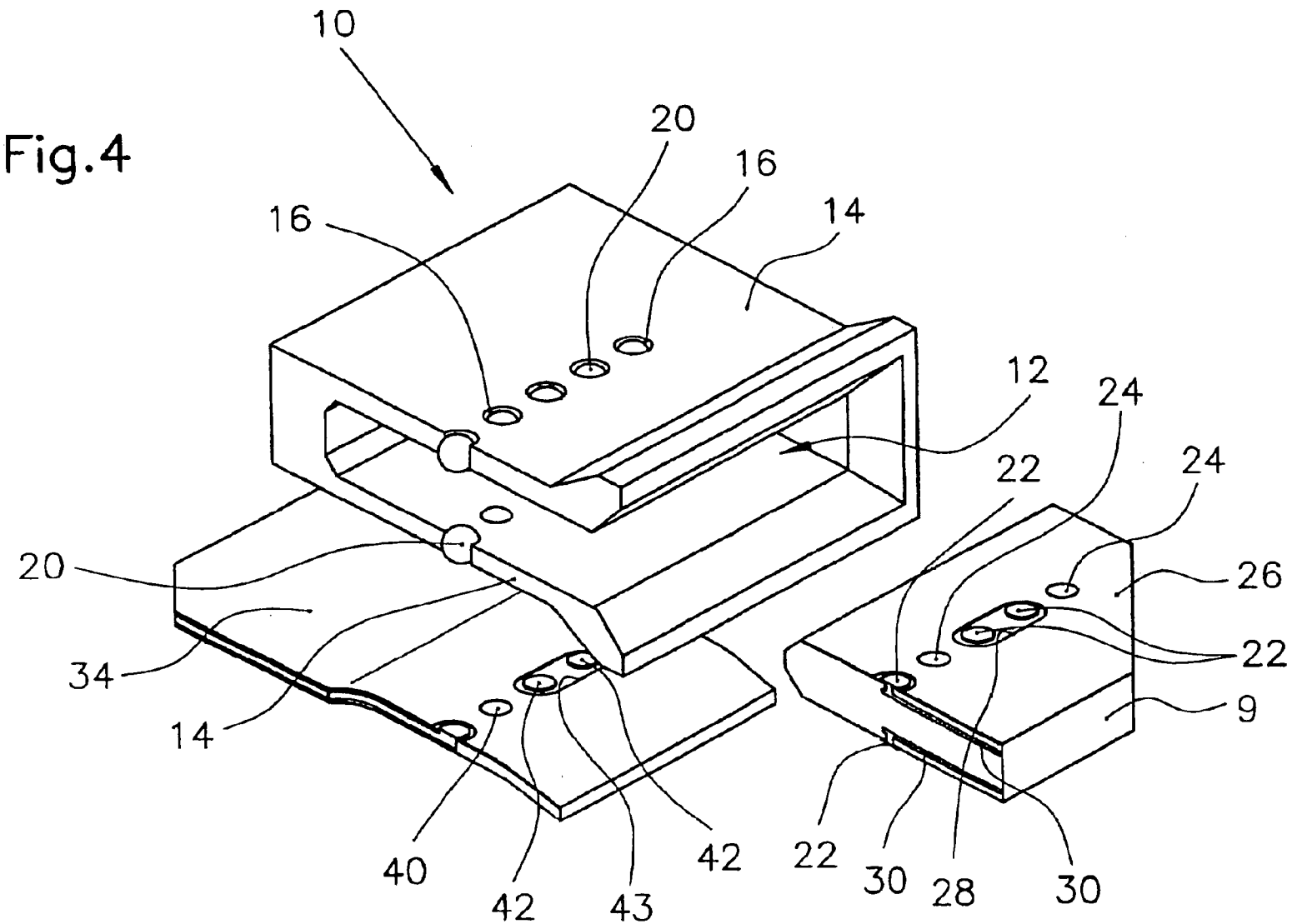
FIG. 4 shows the carrier of the connector of FIG. 1 with a conductor foil and a plug-in card in a schematic, sectional exploded view.
Figure 5:
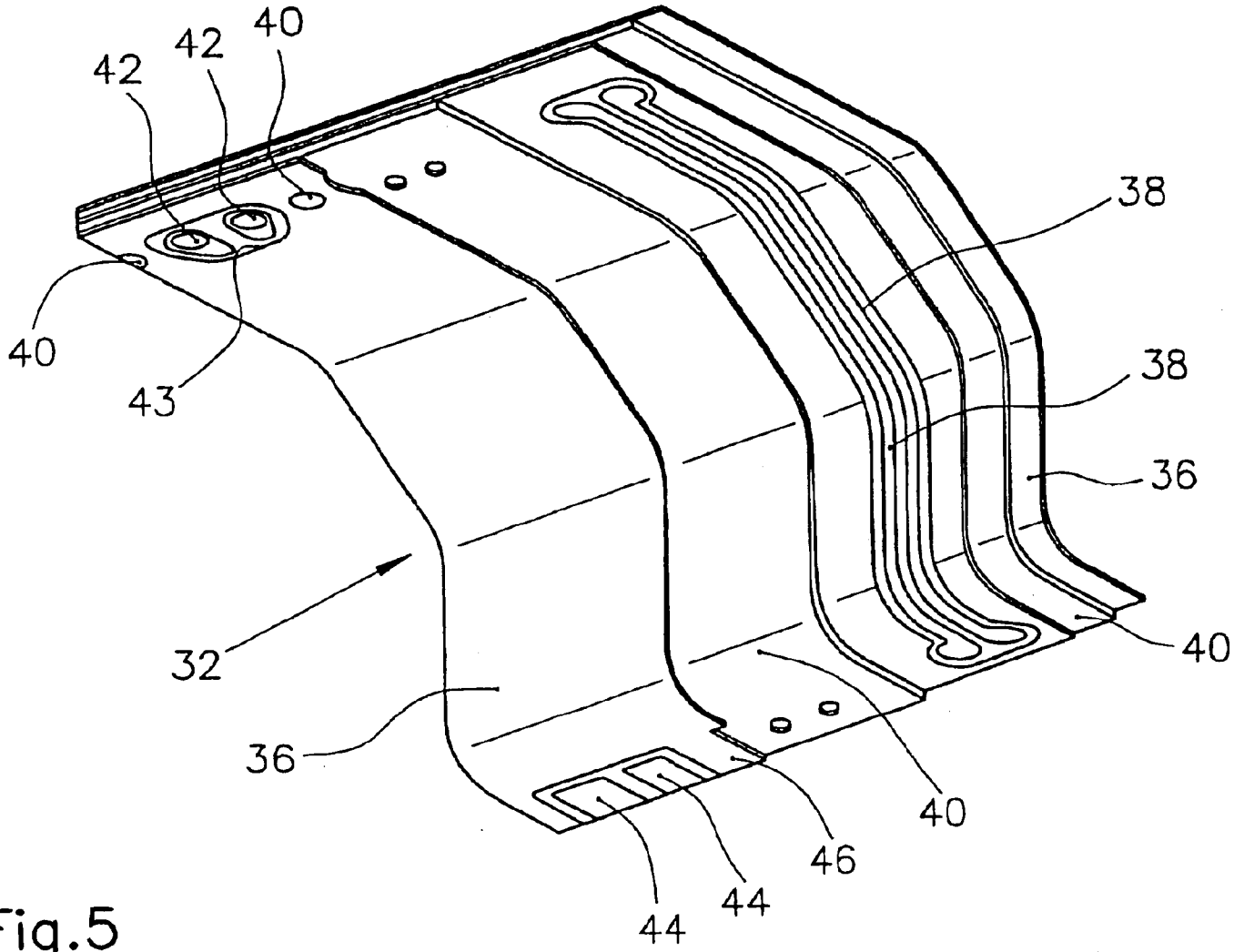
FIG. 5 shows the various layers of a conductor foil which is used in the connector of FIG. 1 in a perspective view.

Each contact ball 20 is associated to a contact surface 22, 24, which is formed on the upper and lower surface, respectively, of the plug-in card 9. The contact surfaces 22 are used for signal transmission and are arranged in pairs between the contact surfaces 24, which serve as ground contact. The diameter of the signal contact surfaces 22 and of the ground contact surfaces 24 approximately corresponds to the diameter of the contact balls 20. The ground contact surfaces 24 are disposed on a ground wire 26, which covers the upper surface and the lower surface of the plug-in card 9. The signal contact surfaces 22 are disposed in recesses 28, which are formed between two adjacent ground contact surfaces 24, and connected with conductor paths 30, which extend inside the plug-in card 9 and therefore are shielded by the ground wires 26 (see FIG. 4). The adjacent conductor paths 30 of two adjacent signal contact surfaces 22 form a symmetrical conductor pair.

The carrier 10 is accommodated in a housing 21 which serves for mounting the connector 5 on the printed circuit board 7 as well as for accommodating further components of the connector, which will be explained below. The illustrated embodiment is a composite housing which consists of plastic material and an attached reinforcing plate made of metal.

For bonding the contact balls 20 two flexible conductor foils 32, 34 are provided, which proceeding from the outer surfaces of the side walls 14 extend out of the housing 21 of the connector 5. Each conductor foil 32, 34 has a similar structure as the plug-in card 9, i.e. has two flat ground wires 36 which form the outer surface, as well as conductor paths 38 disposed inside, which are embedded in an insulating base material 40. Here as well, two adjacent conductors 38 form a symmetrical conductor pair.

At the end of the conductor foil 32 facing the contact balls 20, several ground contact fields 40 are formed at the ground wire 36, between which signal contact fields 42 are arranged in pairs, which are connected with the conductor paths 38. The signal contact fields 42 arranged in pairs are each disposed in a recess 43 of the ground wire 36. At the opposite end of the conductor foil 32, which extends out of the connector 5, the conductor paths 38 extend to signal soldering surfaces 44, which can be connected with the conductor paths 8 of the printed circuit board 7. Between a pair of signal soldering surfaces 44 there is each provided a ground soldering surface 46.

For fixing the conductor foils 32, 34 at the carrier 10, the same is provided with a plurality of fixing pins 48, which engage in corresponding fixing holes 50 in the conductor foils 32, 34.

In the interior of the connector between the carrier 14 and the housing 21 two springs 52 are disposed, which serve to urge the ground contact surfaces 40 and the signal contact surfaces 42 of the conductor foils 32, 34 against the contact balls 20 and thus urge the contact balls 20 towards the receiving space 12. The springs 52 are designed in the manner of a bow-type spring and each have an anchoring portion 54 which is attached to the housing 21, a bending portion 56 which extends over an angle of about 270° C., as well as a spring portion 58 which is formed by a plurality of spring shackles disposed one beside the other. One spring shackle each is disposed opposite a contact ball 20, so that the same is acted upon individually. The springs 52 are fixed in the housing by means of fastening pins 60, which are formed at the housing 21 and engage in mounting holes in the anchoring portion 54.

To connect the conductor paths 30 of the plug-in card 9 with the conductor paths 8 of the printed circuit board 7, the plug-in card 9 is inserted directly into the receiving space 12 of the connector 5. The contact balls 20, which in the non-operated condition slightly protrude into the receiving space 12 due to the bias of the spring, are pressed back in the guide holes 16 by the plug-in card 9, until the contact balls 20 rest on the surface of the plug-in card 9, i.e. on the ground wire 26. This can be facilitated by a bevel at the front edge of the plug-in card 9. During the further insertion, the contact balls 20 slide across the surface of the plug-in card 9, and in dependence on the frictional conditions the contact balls 20 can also rotate. Shortly before the plug-in card 9 is completely inserted in the receiving space 12, the contact balls 20 associated to the signal contact surfaces 22 briefly dip into the recesses 28 which are provided around the signal contact surfaces. This is, however, easily possible due to the resilient arrangement of the contact balls 20.

When the plug-in card 9 is completely inserted in the receiving space 12, the contact balls 20 centrally rest on the signal contact surfaces 22 and the ground contact surfaces 24. Since the contact balls 20 are clamped between the contact surfaces of the plug-in card 9 and the contact fields of the conductor foils 32, 34 by the spring shackles of the spring portion 58 individually and independently with a uniform contact force, a good bonding is obtained. Since the diameter of the contact surfaces 22, 24 of the plug-in card 9 as well as of the contact fields 40, 42 of the conductor foils 32, 34 approximately corresponds to the diameter of the contact balls 20, there is obtained a high transmission quality for radiofrequency signals. What also contributes to the high signal transmission quality is the fact that the conductor paths 30 in the plug-in card 9 and 38 in the conductor foils 32, 34 each extend shielded between flat ground wires. What finally contributes to the high signal transmission quality is the fact that between each pair of signal transmission contacts one ground contact is arranged.

Figure 7:
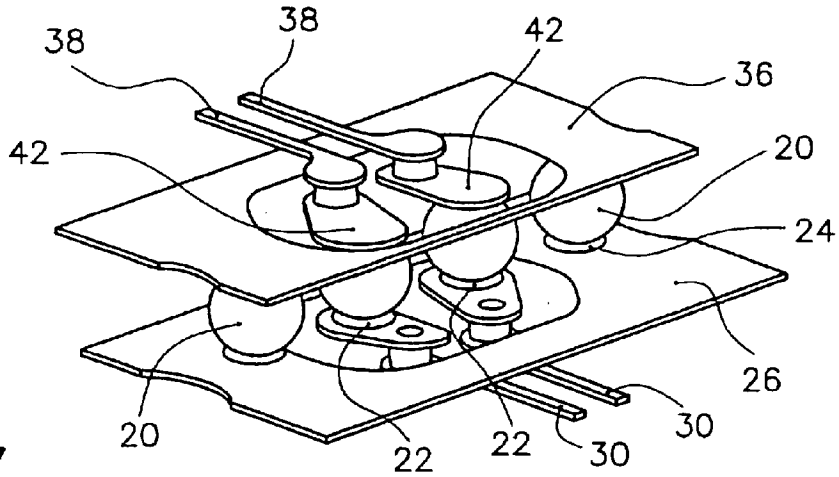
FIG. 7 shows the bonding between opposed contact surfaces in accordance with the variant of FIG. 6 in a simplified perspective view.
Figure 6:
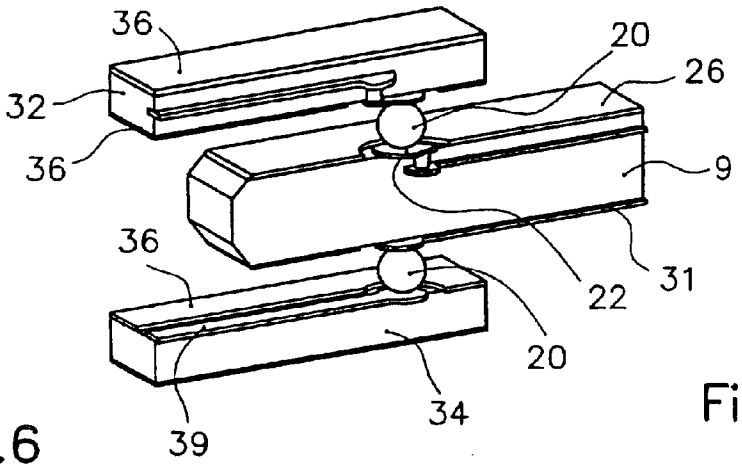
FIG. 6 shows the bonding of a plug-in card in accordance with a first variant in a schematic, perspective view.

FIGS. 6 and 7 show the details of a variant of the embodiment shown in FIGS. 1 to 5. For the components which are known from the preceding embodiment the same reference numerals are used, and in so far reference is made to the above explanations.

In the variant of FIGS. 6 and 7, the conductor paths 39 of the second conductor foil 34 are not disposed shielded in the interior of the conductor foil, but extend on the surface in the recess 43 of the ground wire 36. Similarly, the associated conductor paths 31 of the plug-in card 9 do not extend in the interior of the plug-in card, but on the surface. This embodiment, which is simpler in terms of shielding, is recommended in particular when lower frequency signals are to be transmitted over the second conductor foil 34.

Another difference from the embodiment shown in FIGS. 1 to 5 consists in that the signal contact surfaces 22 of the plug-in card 9 as well as the signal contact surfaces 42 of the conductor foil 32 are of a drop-shaped design (see in particular FIG. 7). The tip of the drop serves for bonding with the conductor paths 30 and 38, respectively, and the actual contact surface lies in the region of the belly of the drop. The width of the belly approximately corresponds to the diameter of the contact balls. The advantage of this embodiment consists in that the cylindrical connection between the conductor paths extending in different planes on the one hand and contact surfaces or contact fields on the other hand can be accomplished more easily.

Figure 8:
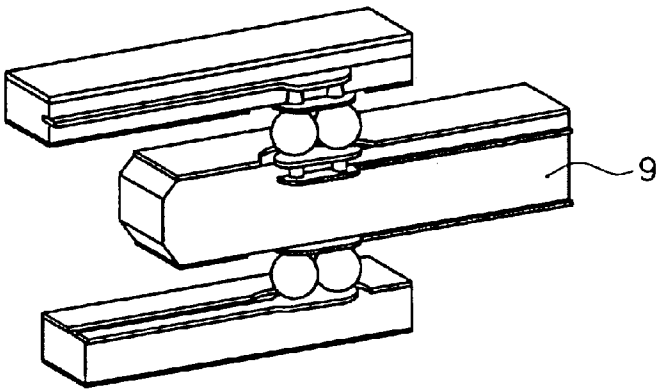
FIG. 8 shows a second variant in a view corresponding to that of FIG. 7.

In FIG. 8, another variant is shown. In contrast to the preceding embodiments, two directly adjacent contact balls 20 are used for each contact field or contact surface. Accordingly, each contact field or each contact surface has an elongate design, and the guide holes 16 (not shown) for the contact balls 20 have the shape of an oblong hole, which is constricted on the side of the receiving space 12 in the carrier 10, so that the contact balls 20 are held in the side walls 14.

Figure 9:
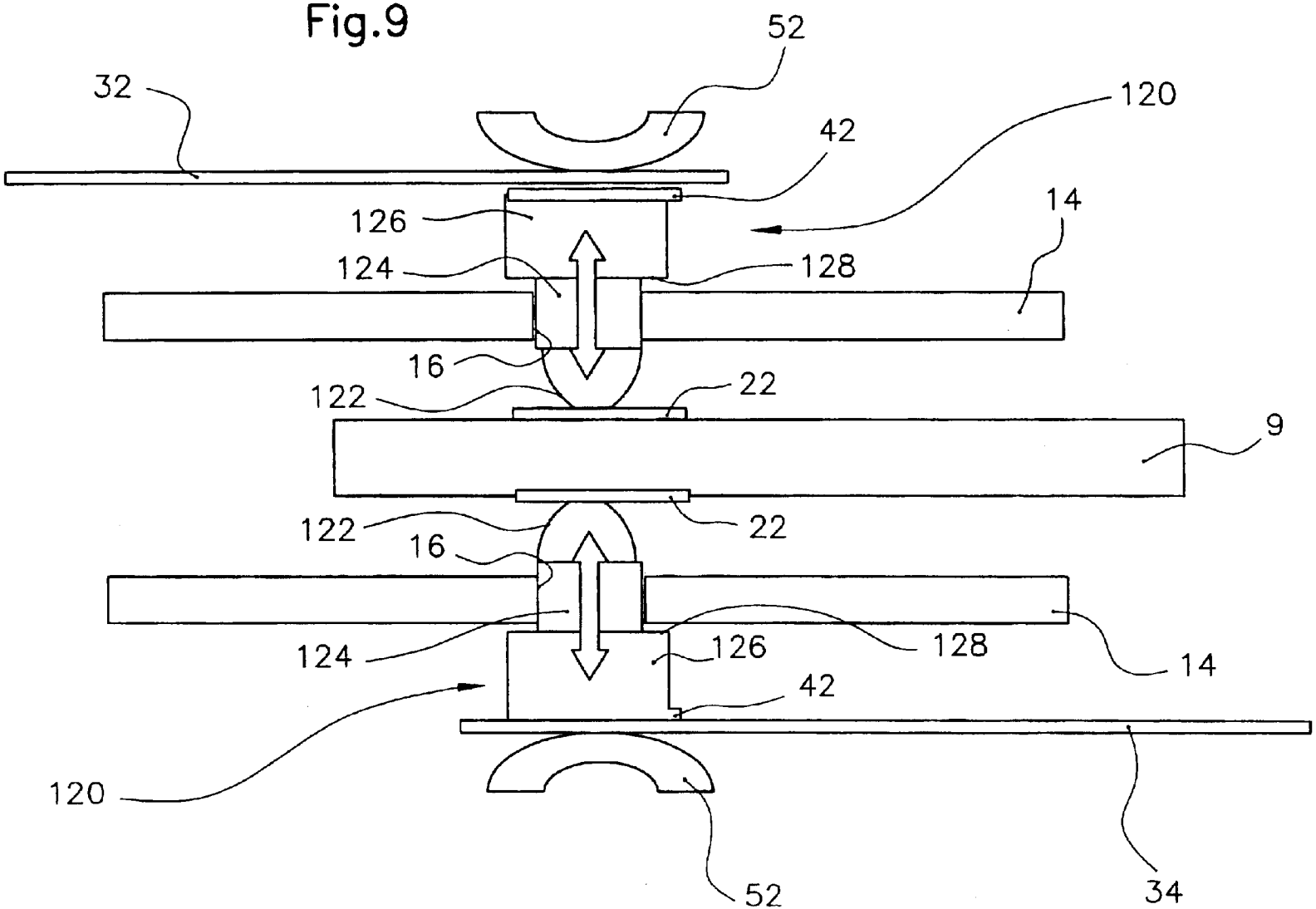
FIG. 9 shows a connector in accordance with a second embodiment of the invention in a schematic side view.

FIG. 9 schematically shows the essential components of a connector in accordance with a second embodiment of the invention. For the components known from the first embodiment, the same reference numerals are used, and reference is made to the above explanations.

The difference from the first embodiment consists in that instead of the contact ball a contact pin 120 is used as contact element. The contact pin 120 has a rounded tip 122, a cylindrical guide portion 124 and adjacent thereto an expanded holding portion 126. The rounded tip 122 is provided for bonding the contact surfaces 22, 24 of the plug-in card 9. The guide portion 124 is movably accommodated in the guide hole 16 of the side wall 14 of the carrier; its diameter is slightly smaller than the diameter of the guide hole 16. The holding portion 126 lies outside the carrier. Since the holding portion has a larger diameter than the guide portion 124, a shoulder surface 128 is formed, by which the contact pin 120 can rest on the outside of the side wall 14. The shoulder surface serves as stop and determines how far the contact pin 120 can be pressed into the receiving space 12 by the spring 52 engaging the contact pin. Between the spring 52 and the holding portion 126 the conductor foil 32, 34 is arranged such that the corresponding contact field is bonded.

The diameter of each contact pin is less than 0.5 mm; with regard to a rather compact design, there is preferably chosen a diameter of about 0.1 mm. In the same way as the contact balls, the contact pins 120 are gold-plated.

The advantage of the second embodiment consists in that the guide holes can be designed to continuously have the same diameter; there is not required a constriction of the guide hole 16, in order to form a stop for the contact element. Another advantage should consist in that contact pins are basically better suited for the transmission of RF signals than contact balls.

What is claimed is:

1. A connector for receiving a plug-in card comprising:

a carrier which defines a receiving space for said plug-in card;

at least one guide hole which is formed in said carrier and which opens in said receiving space, a contact element which is movably arranged in said guide hole;

a spring which urges said contact element towards said receiving space; and a conductor path which is electrically connected with said contact element, wherein said conductor path is formed on a flexible conductor foil and ends in a contact field against which said contact element rests, and wherein said conductor foil is arranged between said spring and said carrier, said spring pressing on a side of said conductor foil facing away from said contact field.

2. The connector of claim 1 wherein said contact element is a contact ball which is movably arranged in said guide hole.

3. The connector of claim 2 wherein on a side facing said receiving space said guide hole is provided with a collar having a diameter smaller than a diameter of said contact ball.

4. The connector of claim 2 wherein said diameter of said contact ball lies in the order of 0.5 mm.

5. The connector of claim 2 wherein two of said contact balls are provided, said contact balls being arranged adjacent each other in said guide hole.

6. The connector of claim 2 wherein said contact element is a contact pin which is movably arranged in said guide hole.

7. The connector of claim 6 wherein said contact pin has a rounded tip, a cylindrical guiding portion and adjacent thereto an expanded holding portion, said guiding portion having a diameter which approximately corresponds to a diameter of said guide hole.

8. The connector of claim 6 wherein said contact pin has a diameter in the order of maximally 0.5 mm.

9. The connector of claim 8 wherein said contact pin has a diameter of about 0.1 mm.

10. The connector of claim 1 wherein said contact element is gold-plated.

11. The connector of claim 1 wherein said spring is a bow-type spring with an anchoring portion, a bending portion and a spring portion which acts on said contact element.

12. The connector of claim 1 wherein a housing is mounted on said carrier, said housing being provided with a fastening means for said spring.

13. The connector of claim 12 wherein said housing is provided with a fastening pin and said spring is provided with a mounting hole, said fastening pin extending through said mounting hole.

14. The connector of claim 1 wherein said contact field is drop-shaped and has a width which approximately corresponds to a diameter of said contact element.

15. The connector of claim 1 wherein said carrier is provided with a fixing pin and said conductor foil is provided with a fixing hole, said fixing pin extending through said fixing hole.

16. The connector of claim 1 wherein said conductor foil has at least one ground wire used for shielding.

17. The connector of claim 16 wherein said conductor path extends inside said conductor foil.

18. The connector of claim 16 wherein said conductor path extends on a surface of said conductor foil and is shielded by said laterally arranged ground wire.

19. The connector of claim 1 wherein said conductor foil extends to outside of said housing and said conductor path ends there with a soldering surface.

20. The connector of claim 1 wherein contact elements are provided in a first and in a second row, said rows being arranged on opposed sides of said carrier.

21. The connector of claim 20 wherein said contact elements of said first row are electrically connected with conductor paths which extend in a shielded conductor foil, and said contact elements of said second row are electrically connected with conductor paths which extend on said surface of a conductor foil.

22. The connector of claim 20 wherein said spring has a plurality of spring shackles, each of which cooperates with exactly one of said contact elements.

23. The connector of claim 1 comprising two conductor paths each are designed as symmetrical conductor pair.

24. The connector of claim 1 wherein in said receiving space a plug-in card is inserted, which is provided with a contact surfaces, and said contact elements resting on said contact surfaces with a defined contact force which is determined by said spring.

* * * * *

UNITED STATES PATENT AND TRADEMARK OFFICE

CERTIFICATE OF CORRECTION

PATENT NO. : 6,857,908 B2
DATED : February 22, 2005
INVENTOR(S) : Burmeister

It is certified that error appears in the above-identified patent and that said Letters Patent is hereby corrected as shown below:

Title page,
Item [73], Assignee, should be -- Harting Electro-Optics GmbH & Co. KG --.

Signed and Sealed this

Twenty-fourth Day of May, 2005

JON W. DUDAS
*Director of the United States Patent and Trademark Office*